United States Patent [19]

Wilhere

[11] 3,986,537

[45] Oct. 19, 1976

[54] PNEUMATIC SYSTEM FOR CONTROLLING A CONTAINER-FILLING MACHINE FILLING VALVE

[75] Inventor: Charles V. Wilhere, Pittsburgh, Pa.

[73] Assignee: Horix Manufacturing Company, McKees Rocks, Pa.

[22] Filed: Nov. 11, 1975

[21] Appl. No.: 630,909

[52] U.S. Cl. ..... 141/198; 141/DIG. 2; 137/824

[51] Int. Cl.[2] ..... B65B 57/14

[58] Field of Search ..... 141/129–191, 141/90, 95, 192, 198, 214, 219, 226, 275, 291, 351, 362, 372, DIG. 2; 222/193; 137/804, 805, 824; 53/59

[56] References Cited

UNITED STATES PATENTS

| | | | |
|---|---|---|---|
| 3,441,066 | 4/1969 | Wilhere | 141/148 |
| 3,545,502 | 12/1970 | Nunlist | 141/141 |
| 3,795,263 | 3/1974 | Wilhere | 141/198 |

*Primary Examiner*—Houston S. Bell, Jr.
*Attorney, Agent, or Firm*—Brown, Murray, Flick & Peckham

[57] ABSTRACT

Three fluidic control devices of special construction receive streams of air that are deflected to the atmosphere at predetermined intervals by means of jets of air controlled by valves and the liquid level in a container being filled as a filling machine moves through its cycle. At one point in the cycle, air pressure from one of the fluidic control devices causes the filling valve of the machine to open and remain open until a jet of control air is delivered to another of the fluidic control devices when the desired liquid level in the container is reached, whereupon those two control devices are vented to the atmosphere and the filling valve closes. If a container is not in filling position when it should be, there will be no blow-down through the level-sensing tube and the filling valve will not open.

7 Claims, 6 Drawing Figures

PNEUMATIC SYSTEM FOR CONTROLLING A CONTAINER-FILLING MACHINE FILLING VALVE

In U.S. Pat. No. 3,795,263 pneumatic systems for controlling the operation of filling valves in container-filling machines are disclosed. One of these systems uses two fluidic control devices or impact modulators and the other system uses three modulators. In that patent the modulator that is directly connected to the air-conducting element 35 that is supplied with air from the main source of air pressure has an outlet connected with the pneumatic relay that opens the filling valve of the machine, so the output from this first impact modulator has to be high enough to operate the relay. On the other hand, for the best response and repeatability, this output should be considerably lower than required for opening the filling valve. Furthermore, in the system shown in the patent, overfilling of containers could occur if the start-fill valve happened to be held open by its operating cam at the time the machine stopped rotating. To prevent that from happening, a retractable cam has been used, which is automatically retracted by an air cylinder whenever the machine stops.

It is among the objects of this invention to improve on the patented system by providing a container-filling machine in which the output of the first impact modulator can be kept low because another impact modulator is used for opening the filling valve, and in which a retractable cam is unnecessary for preventing overfilling of a container if the machine stops rotating with the start-fill valve open.

The preferred embodiment of the invention is illustrated in the accompanying drawings, in which FIG. 1 is a fragmentary vertical section of a single filling station of a container-filling machine, with some parts shown in elevation;

Figure 1:
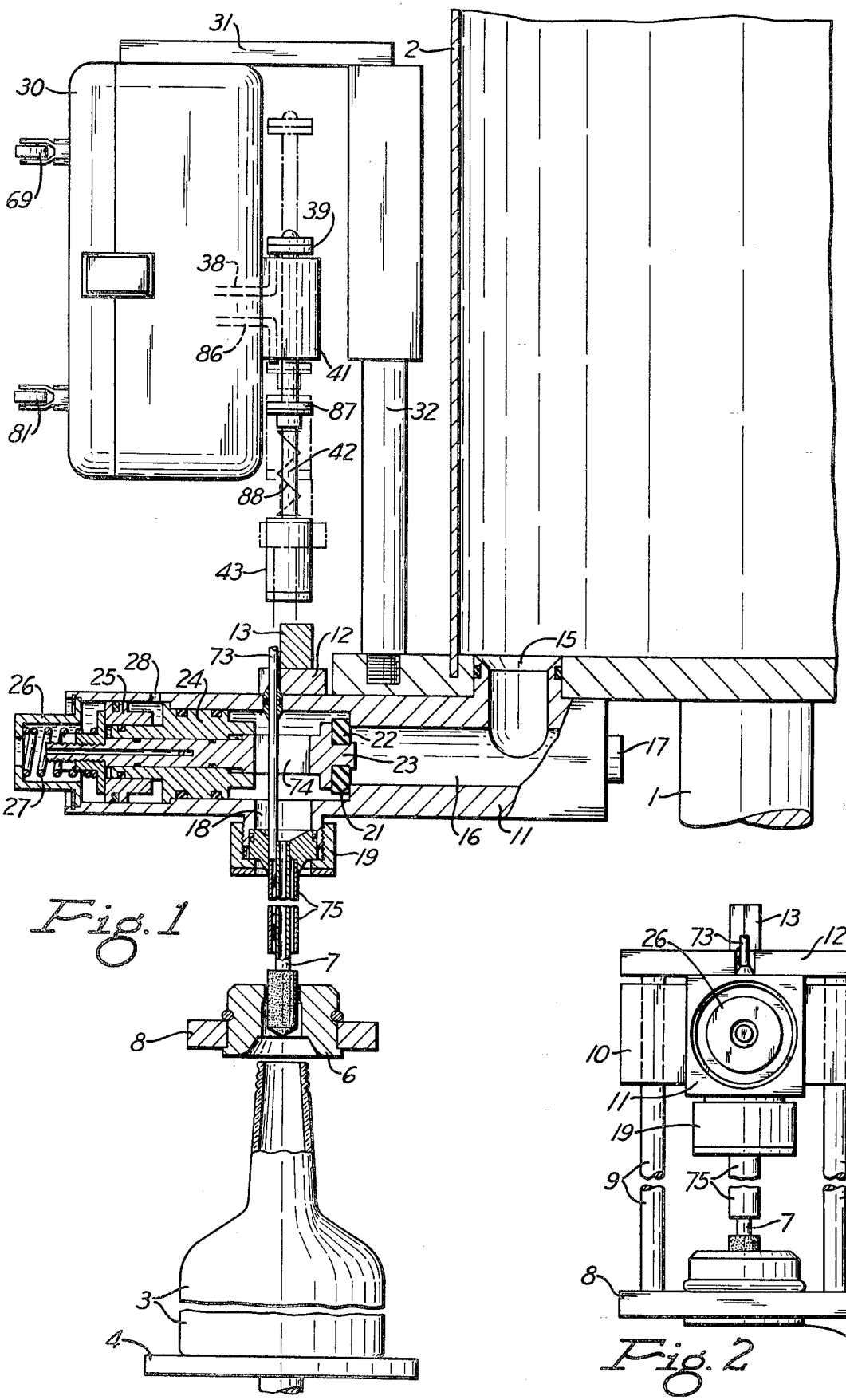
Figure 2:
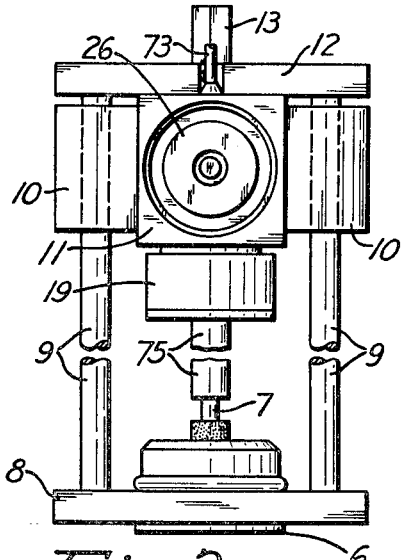
FIG. 2 is a partial end view.

Referring to FIGS. 1 and 2 of the drawings, the type of container-filling machine with which this invention is most useful is the kind in which several filling stations are spaced circumferentially around a rotating center post 1 supporting a liquid product tank 2. At each station a container 3, such as a bottle, is raised by a traveling supporting member 4, in a well-known manner to cause the open upper end of the bottle to first engage a guide 6 at the lower end of the filling tube 7 and then to move the guide upwardly as the bottle moves up around the tube. The guide is supported in a ring 8 suspended from the lower ends of a pair of vertical guide rods 9 shown in FIG. 2 that are slidably mounted in bushings 10 secured to the opposite sides of a horizontal arm 11 projecting radially outwardly from the bottom of the tank. As the post rotates, it carries the arm and like arms at the other stations of the machine in a circle around the axis of the post. The upper ends of the two guide rods are mounted in a cross bar 12 normally resting on top of the arm and provided centrally with an upwardly projecting boss 13.

The tank is provided above the inner end of the arm with an outlet port 15 that opens the top of a longitudinal passage 16 in the arm. The inner end of the arm is closed by a plug 17. The bottom of the arm has an outlet port 18 connected by a coupling 19 to the upper end of the filling tube. Inside the arm, between its inlet and outlet ports, there is a valve seat 21 that normally is closed by a filling valve member 22 mounted on the inner end of a horizontal piston rod 23 slidable in a bushing 24 rigidly mounted in the arm between its outer end and its outlet port. Mounted on the outer end of this piston rod is a piston 25, between which and a cup 26 projecting from the outer end of the arm a coil spring 27 is compressed to hold the valve member against seat 21. Between the piston and bushing 24, the arm is provided with an inlet 28 for air under pressure, by which the piston can be moved toward the outer end of the arm to unseat the valve member so that liquid from the tank can flow past it and down through the filling tube into the bottle.

After a bottle has been placed on its support 4 and elevated around the lower end of the filling tube, thereby raising guide 6 and cross bar 12, the rotation of the machine causes a valve to be opened for a moment so that air under pressure will be delivered to the arm through its inlet 28 to open the filling valve. The pneumatic pressure system that accomplishes this is carried by the machine, except for the primary source of air pressure, such as an air compressor or pressure tank, and there is a separate pneumatic pressure system for each individual filling valve. Most of the elements of the pneumatic system are enclosed in a case 30 supported by a bar 31 extending outwardly from the upper end of a post 32 screwed into the marginal area of the bottom of the tank that projects beyond its side wall. Reference will now be made to FIGS. 3 to 6 to explain the construction and operation of the pneumatic system.

Figure 3:
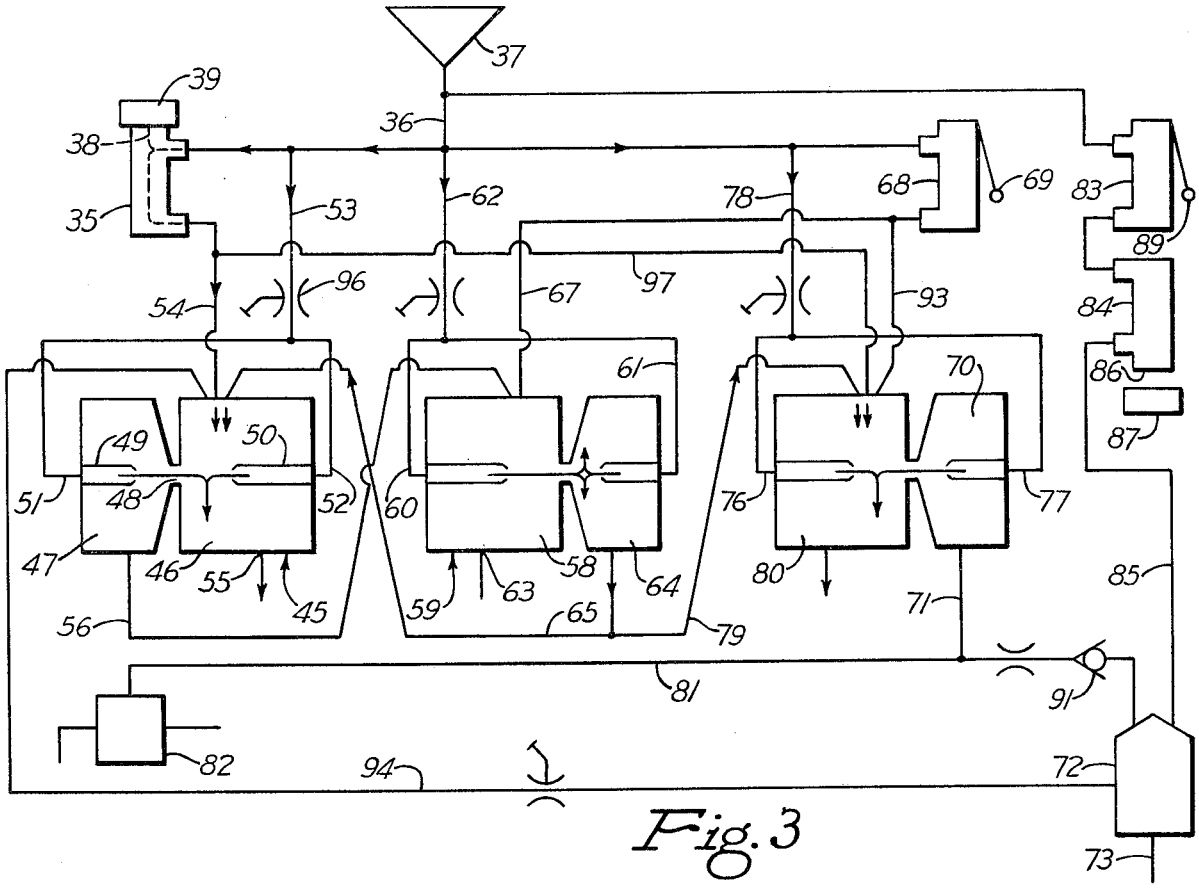
FIG. 3 is a diagram of the pneumatic pressure system that controls the filling valve, showing the system before a container is in filling position.

Inside of case 30 of FIG. 1 there is an air-conducting element 35, shown in FIG. 3, having an inlet connected by a main supply tube 36 to the source of air pressure 37. This element also has a main outlet for the air, and a bypass 38 that can exhaust to atmosphere when a closure member 39 is separated from the bypass outlet. This separation is effected by the elevation of a container into filling position. Referring back to FIG. 1 the bypass extends out of the case and up through the top of a block 41 attached to the side of the case. Normally resting on top of the bypass and closing it is the closure member 39, which is mounted on the upper end of a rod 42 that is slidable vertically in the block. The rod also extends below the block and carries a weight 43 on its lower end, which is engaged and lifted by the boss 13 on top of cross bar 12 when the guide rods are lifted by a container. This will open the bypass so that air will not flow out of the main outlet of air-conducting element 35.

The case also contains three fluidic control devices, sometimes called impact modulators. The first such device 45 is provided with a control chamber 46 and an output chamber 47 that are connected by a central orifice 48. The outer ends of the two chambers are provided with air inlets aligned with the central orifice. Nozzles 49 and 50 extend from these inlets toward that orifice, but their inner ends are spaced from it. The two inlets are connected by tubes 51 and 52, respectively, to a tube 53 leading from supply tube 36. The modulator is so constructed that if the streams of air issuing from the two nozzles are not interfered with, they will impinge upon each other in the area between the central orifice 48 and the outlet of nozzle 49 in the output chamber and raise the air pressure therein. The main outlet of air conducting element 35 is connected by a tube 54 with the side of the control chamber 46 in a position to cause a jet of air to impinge upon the side of the stream issuing from the nozzle in that chamber. This deflects the stream laterally so that the stream from nozzle 49 can enter the control chamber, which is vented to the atmosphere by way of an outlet 55. The output chamber, on the other hand, is provided with an outlet connected by a tube 56 with the side of the control chamber 58 of the second fluidic control device 59. The inlets to the two nozzles of this device are connected by tubes 60, 61 and 62 with the main air supply tube 36. The control chamber has an outlet 63 to atmosphere, and the output chamber 64 has an outlet connected by a tube 65 to the side of the control chamber of the first impact modulator.

Since in FIG. 3 the opposed streams of air in the second modulator 59 are not being deflected by deflecting jets of air, they are impinging on each other in the output chamber, which causes the air therein to build up pressure and flow out through tube 65 to the control chamber of the first modulator 45. The jet of air issuing from this tube is directed to deflect the streams from the two nozzles 49 and 50, even if the flow from tube 54 is shut off. The side of the control chamber of the second modulator 59 is also connected by a tube 67 to the outlet of a normally closed start-fill valve 68, the inlet of which is connected to the main supply tube 36. This valve is provided with an actuating member 69 that extends out of case 30 and that engages a stationary cam (not shown) for only a moment during each revolution of the filling machine, whereby to open the valve for a moment to deliver a jet of deflecting air to the side of control chamber 58.

The third fluidic control device has an output chamber 70 that is provided with an outlet connected by a tube 71 with a junction chamber 72, from the bottom of which a tube 73 extends down through arm 11 and a slot 74 in piston rod 23 and into the upper end of a level-sensing tube 75 encircling the filling tube, as shown in FIG. 1. The sensing tube extends down into a container while it is being filled, with the lower end of the tube located at the liquid level desired in the container, as is well known. The third modulator also has aligned openings at its opposite ends connected by the tubes 76 and 77 to a tube 78 leading from air supply tube 36. The outlet of the output chamber 64 of modulator 59 is connected by a tube 79 to the side of the control chamber 80 of the third modulator. The outlet of the output chamber 70 is connected by the tube 71 and a tube 81 with a pneumatic relay 82 which, when opened by air from the tube 81, connects pressure source 37 or some other source of high pressure with a tube leading to the air inlet 28 (FIG. 1) of the filling valve.

There also is a second normally closed valve, i.e., a blow-down valve 83, in case 30. The inlet of this valve is connected with air pressure source 37, and the valve outlet is connected to the inlet of an air-conducting element 84 like element 35. The main outlet of this element is connected by a tube 85 to junction chamber 72. The air-conducting element 84 also is provided with a bypass 86 to atmosphere that normally is open but that is closed by a closure member 87 when a container is raised into filling position. As shown in FIG. 1, this closure member likewise is mounted on the vertical rod 42, but it is below block 41 and engages the outlet of the bypass 86 that extends from air-conducting element 84 into the block and downwardly out of its bottom. The closure member is slidable on the rod, where it is supported by a coil spring 88 so that the rod can be raised different distances by containers of different heights without interference from the closure member in its upper position.

Figure 4:
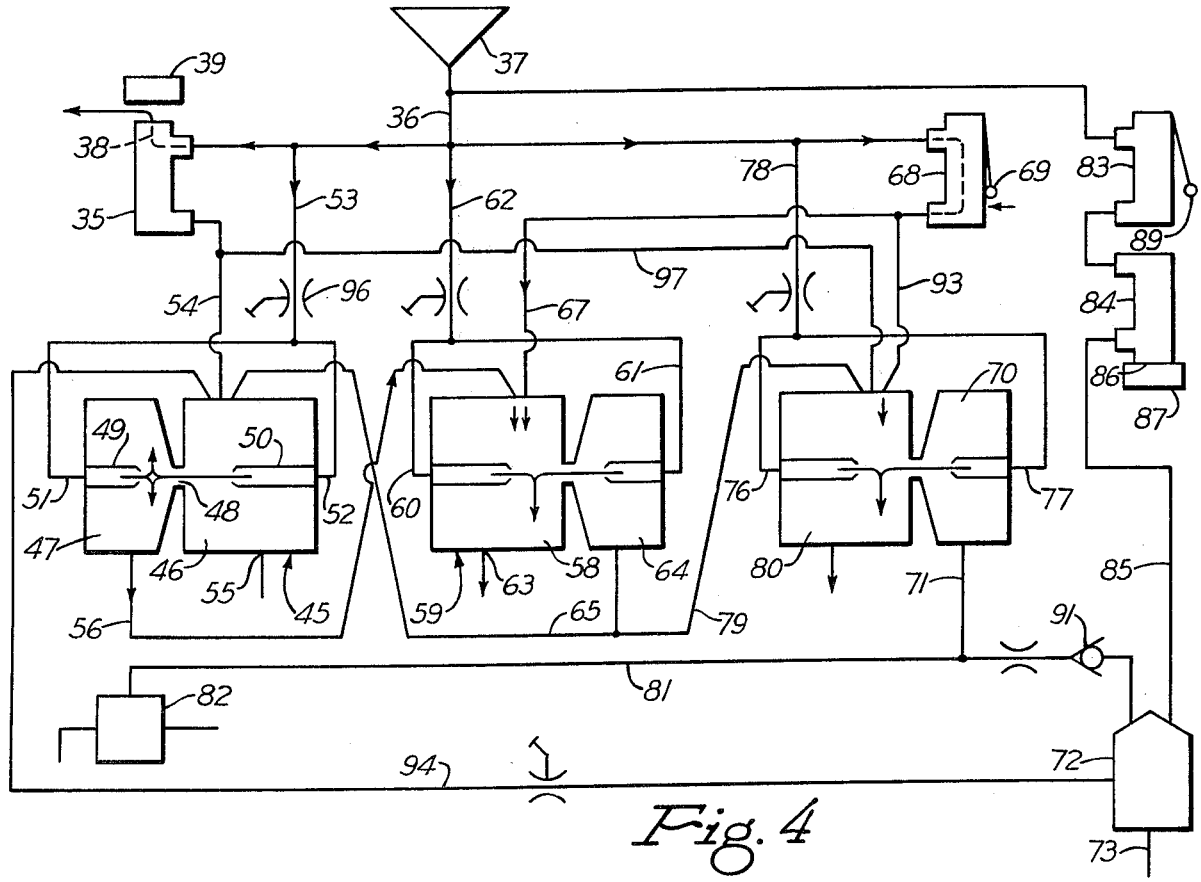
FIG. 4 is a diagram of the system when a container is in filling position and the start valve is open for a moment after blow-down, but filling has not yet started.

As indicated before, when there is no container in position at a filling station served by the pneumatic control system illustrated in FIG. 3, the flow of air is as indicated by the arrows in that diagram, so the filling valve remains closed and also there is no flow of air from the third modulator to junction chamber 72 and liquid level-sensing tube 75. When a bottle is placed on its support 4 and is raised, it raises rod 42 to open bypass 38 and to close bypass 86 as shown in FIG. 4. This cuts off flow of deflecting air through air-conducting element 35 to the side of the control chamber of the first modulator 45, but for a short time before the start valve 68 is opened, the pattern of air flow in that device remains the same as before because the air streams from nozzles 49 and 50 are still deflected by the jet of air entering through tube 65 from the output chamber of the second modulator 59. However, the rotating machine soon carries the actuating member 89 of the blow-down valve into engagement with its cam so that the valve is opened momentarily to allow a jet of air to flow into junction chamber 72 and down through the level-sensing tube to clear that tube of any liquid product that may be in it and to remove drops of liquid left on its lower end. The blow-down is into the bottle about to be filled. A check valve 91 in tube 71 between tube 81 and the junction chamber prevents this jet of air from flowing back through tube 81 and actuating relay 82. If no container is present, closure member 87 will not have been raised to close bypass 86, so there will be no blow-down of drops of liquid onto the machine or onto adjacent containers. This helps to keep the machine and its surroundings clean.

Immediately after the blow-down, the actuating member 69 of the start valve strikes its cam to open that valve, as shown in FIG. 4, to thereby cause a jet of deflecting air to flow through tube 67 and strike the side of the impinging streams in the second modulator 59. This deflects them through the chamber outlet 63 to the atmosphere, whereby the flow of air through tubes 65 and 79 from output chamber 64 is cut off. It follows that since there no longer are any jets of deflecting air entering the side of control chamber 46 of the first modulator, the streams from the nozzles therein now impinge in the output chamber and build up pressure in tube 56 so that air from the output chamber flows through that tube to the control chamber 58 of the second modulator to maintain the deflection of the air streams therein after the start valve 68 closes on leaving its cam. Although at this time there no longer is deflecting air entering control chamber 80 from tube 79, the impinging streams from tubes 76 and 77 remain deflected by air from a tube 93 connecting that chamber with the outlet of start-fill valve 68 as long as that valve remains open, as shown in FIG. 4. The advantageous result of this is that if the machine stops moving while valve 68 is open, the filling valve will remain closed, which is a feature of this invention.

Figure 5:
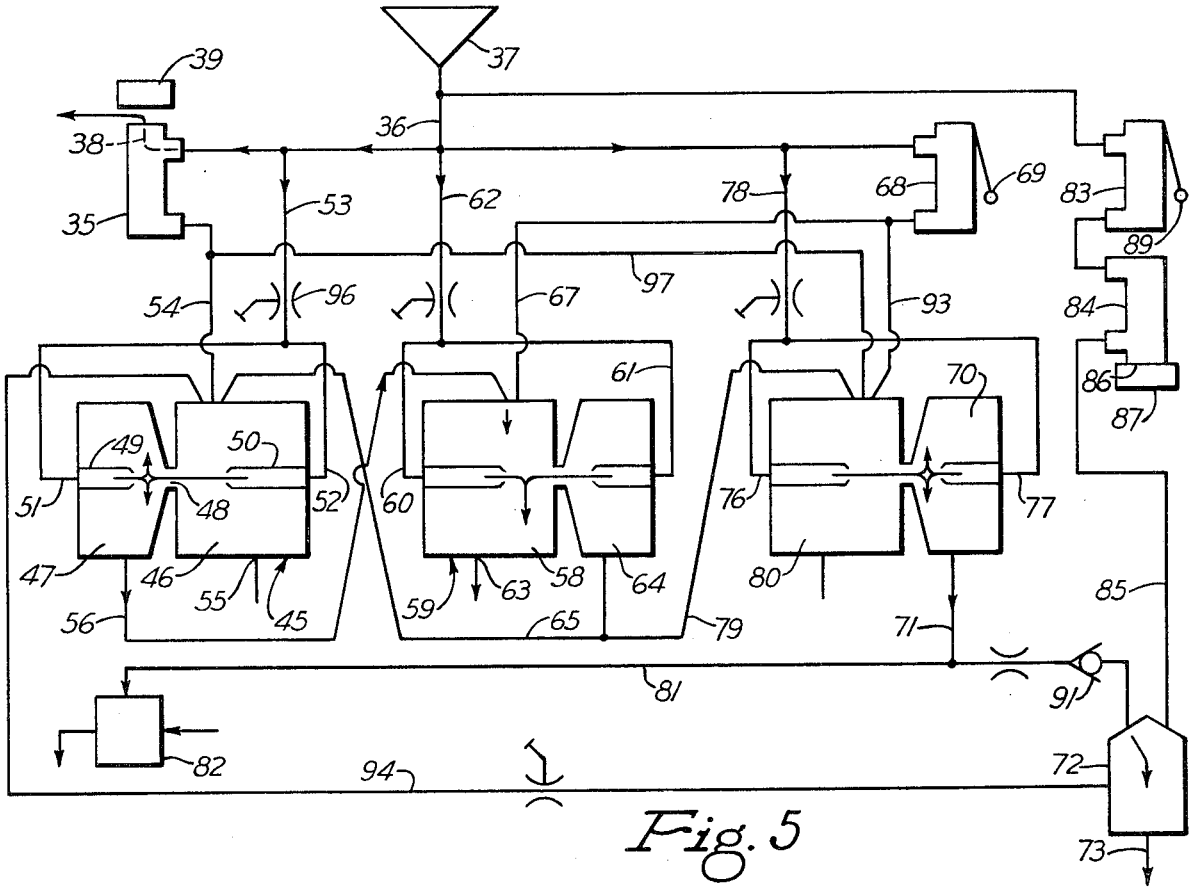
FIG. 5 is a diagram of the system after the start valve has closed and the machine is filling.
Figure 6:
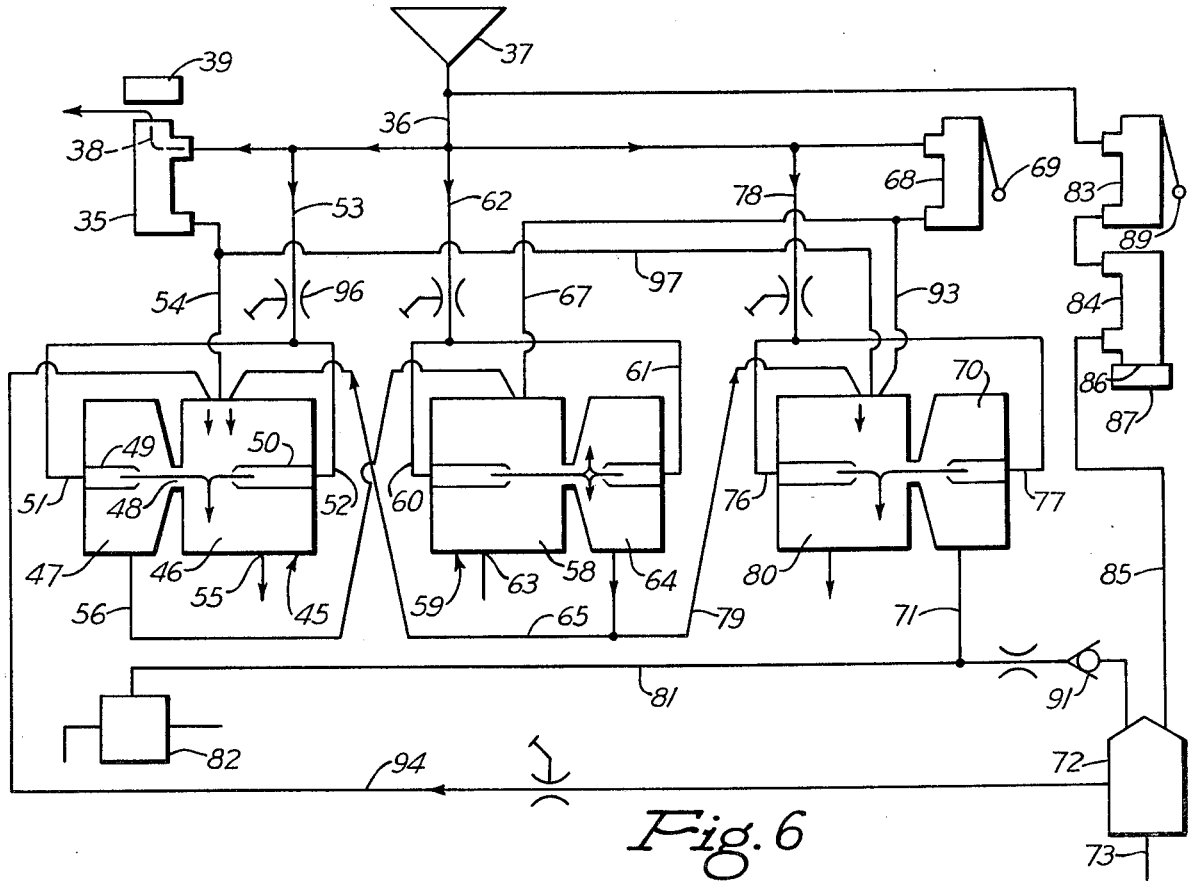
FIG. 6 is a diagram of the system at the moment that filling is stopped.

However, as soon as valve 68 leaves its actuating cam, the valve closes so all deflecting air is cut off from control chamber 80 of the third modulator as shown in FIG. 5. When this occurs, air pressure builds up in output chamber 70 and, via tubes 71 and 81, actuates pneumatic relay 82 to open the filling valve. With the filling valve open, the bottle is filled with liquid from the tank until the liquid rising in the bottle shuts the outlet of the sensing tube 73. Immediately upon this occurring, air pressure is built up in a tube 94 extending from junction chamber 72 back to the side of the control chamber 46 in the first modulator so that the impinging streams therein are again deflected to the exhaust port 55 of the control chamber, as shown in FIG. 6. This shuts off flow of air through tube 56 to the second modulator, so the opposed air streams in that device again impinge in its output chamber 64, from which air flows out through tube 65 and back to the control chamber of the first modulator to maintain air stream deflection therein, even though the deflecting air from junction chamber 72 was shut off the moment the jet of air from the tube 94 entered control chamber 46, due to air flowing from output chamber 64 through tube 79 to the control chamber 80 of the third modulator where it deflected the air streams therein to exhaust. That reduced the air pressure in tube 71 so that relay 82 closed, allowing spring 27 to close the filling valve.

The above-described feature of this invention, by which the opening of the filling valve is controlled by the third impact modulator instead of by the first modulator 45, permits the output from chamber 47 of the first modulator to be considerably lower than heretofore because the pressure in that chamber does not have to be great enough to operate pneumatic relay 82. This is a definite advantage, as it ensures more reliable operation of the machine. The air pressure delivered to nozzles 49 and 50 of impact modulator 45 can be controlled and reduced relative to the other modulators by a variable restrictor 96 in line 53.

As soon as the filled bottle is lowered to release it from guide 6, the closure member 39 for the first air-conducting element 35 is allowed to descend and close its bypass 38, and the closure 87 for the second air-conducting element 84 drops away from its bypass 86. Consequently, the circuit returns to the condition shown in FIGS. 3, ready for the next container to be filled.

If there is no container in filling position when start-fill valve 68 passes the cam that moves valve-actuating member 69 to open that valve, nevertheless air will be delivered to the control chambers of the second and third impact modulators through tubes 67 and 93. This will prevent output at tubes 79 and 71 and the filling valve will remain closed. However, as member 69 leaves the cam and valve 68 closes, it is possible that in some cases the air streams from nozzles 76 and 77 could build up pressure for a moment in output chamber 70 before renewed air flow from tube 79 would again divert the air in the third modulator to exhaust. Such a situation would cause the filling valve to open. To avoid such a malfunction, it is advisable to connect the outlet of air conducting element 35 with control chamber 80 by means of a tube 97. The air from this tube will keep the meeting air streams in the third modulator diverted to exhaust as shown in FIG. 3, even though a jet of air does not issue from tube 79 at the moment valve 68 closes. On the other hand, there is no reason at all to have tube 97 in case the air issuing from the normal outlet of air-conducting element 38 is used for operating a valve that shuts off air to valve 68 when no container is present.

The pneumatic pressure system disclosed herein operates with only three fluidic control devices and two cam-operated valves. The container itself determines whether the filling valve will open and the blow-down operate. In the absence of a container, the filling valve remains closed and the blow-down does not operate even though the machine otherwise goes through its cycle.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In a container-filling machine, a pneumatic pressure system for controlling the operation of means for opening a filling valve, the system comprising first and second and third fluidic control devices each provided with a control chamber and an output chamber connected by an orifice, each control chamber having an outlet to atmosphere and each output chamber having an air pressure outlet, each fluid control device having a pair of opposed inlets aligned with its orifice with one of said inlets opening into the control chamber and the other of said inlets opening into the output chamber, means for continuously delivering air under pressure to both inlets of each control device simultaneously to form air streams that normally meet in the output chamber to produce air pressure therein, a first conduit connecting the pressure outlet of the first control device with the control chamber of the second control device to direct a jet of air against the side of the air stream therein to deflect the stream to the outlet of the control chamber, a second conduit connecting the pressure outlet of the second control device with the control chamber of the first control device to direct a jet of deflecting air against the side of the air stream therein, a third conduit connecting the pressure outlet of the second control device with the control chamber of the third control device to direct a jet of deflecting air against the side of the air stream therein, a fourth conduit connecting the pressure outlet of the third control device with said valve-opening means to open the filling valve when there is sufficient air pressure in said fourth conduit, means for conducting air from said air-delivering means to the control chamber of the first control device to direct a jet of deflecting air against the side of the air stream therein while no container is in filling position, means operated by a container in filling position for stopping the jet of deflecting air from said conducting means, a normally closed valve for connecting said air delivering means with the control chambers of the second and third control devices and adapted to be opened while a container is in filling position to direct a pulse of deflecting air against the side of the air streams in the control chambers of the second and third control devices to shut off the flow of air through said second and third conduits and to direct a jet of air from said first conduit against the side of the air stream in the control chamber of the second control device, whereby only after said valve closes will air pressure be produced in the output chamber of the third control device to operate said filling valve opening means, and means for deflecting the air stream in the control chamber of the first control device as soon as a container is filled.

2. In a container-filling machine according to claim 1, the air pressure at said opposed inlets of the first control device being substantially lower than the air pressure at the opposed inlets of the third control device.

3. In a container-filling machine according to claim 1, means for reducing the air pressure at said opposed inlets of the first control device to a value substantially lower than the air pressure at the opposed inlets of the third control device.

4. In a container-filling machine according to claim 1, said air-delivering means including a variable restrictor for said first control device.

5. In a container-filling machine according to claim 1, said last-mentioned means including a level-sensing tube having an inlet and an outlet, the outlet of the sensing tube being insertable in the upper part of a container being filled, a fifth conduit connecting the air pressure outlet of the third control device with the inlet of the sensing tube for delivering a stream of air from the tube outlet during container filling, and a sixth conduit connecting the sensing tube inlet with the control chamber of the first control device to direct a pulse of deflecting air against the side of the air stream therein when rising liquid in a container closes the outlet of the sensing tube.

6. In a container-filling machine according to claim 5, the air pressure at said opposed inlets of the first control device being substantially lower than the air pressure at the opposed inlets of the third control device.

7. In a container-filling machine according to claim 5, means for delivering a pulse of air to the inlet of said sensing tube just before container filling starts to clean the tube, and a check valve between said fourth conduit and the inlet of the sensing tube to prevent said last-mentioned pulse of air from opening the filling valve.

* * * * *